US006748869B1

(12) United States Patent
Boyer et al.

(10) Patent No.: US 6,748,869 B1
(45) **Date of Patent: *Jun. 15, 2004**

(54) DEVICE FOR FIRING A PRIMER

(75) Inventors: Jean-Louis Boyer, Collobrieres (FR); AndréGilson, Brussels (BE)

(73) Assignees: Delegation Generale pour l'Armement Batiment la Rotonde, Armees (FR); Jason Engineering S.A., Brussels (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,595

(22) Filed: Dec. 16, 1999

(30) Foreign Application Priority Data

Dec. 16, 1998 (FR) ..... 98 16607

(51) Int. Cl.[7] ..... F42B 23/24
(52) U.S. Cl. ..... 102/428; 102/206
(58) Field of Search ..... 102/206, 401, 102/416, 419–423, 424, 428, 217, 275.11; 200/5 A, 16 R, 159.3; 361/291

(56) References Cited

U.S. PATENT DOCUMENTS

| | | | | | |
|---|---|---|---|---|---|
| 3,398,397 | A | * | 8/1968 | O'Connell | 200/86 R |
| 3,703,866 | A | * | 11/1972 | Semenza | 102/238 |
| 3,717,094 | A | * | 2/1973 | Morrow | 102/427 |
| 3,747,526 | A | * | 7/1973 | Jany | 102/274 |
| 3,754,508 | A | * | 8/1973 | Dalton | 102/215 |
| 3,830,991 | A | * | 8/1974 | Durocher | 200/86 R |
| 3,968,749 | A | * | 7/1976 | Malm | 102/429 |
| 4,143,598 | A | * | 3/1979 | Marer | 102/429 |
| 4,463,681 | A | * | 8/1984 | Tranin et al. | 102/424 |
| 4,476,784 | A | * | 10/1984 | Reynes | 102/424 |
| 4,632,031 | A | * | 12/1986 | Jarrott et al. | 102/200 |
| 4,674,047 | A | * | 6/1987 | Tyler et al. | 102/200 |
| 4,695,681 | A | * | 9/1987 | Velleman | 200/5 A |
| 4,712,423 | A | * | 12/1987 | Siffert et al. | 177/132 |
| 4,742,196 | A | * | 5/1988 | Kelly | 200/85 R |
| 4,762,970 | A | * | 8/1988 | Brinsley | 200/85 R |
| 4,766,271 | A | * | 8/1988 | Mitsuhashi et al. | 200/5 A |

(List continued on next page.)

FOREIGN PATENT DOCUMENTS

| | | |
|---|---|---|
| DE | 32 06 285 A1 | 9/1983 |
| DE | 35 45 289 A1 | 6/1987 |
| DE | 37 06 562 C1 | 7/1996 |

OTHER PUBLICATIONS

UK Patent Application GB 2299850, Oct. 1996, Andrea.*
Trend Times, "Gas Powered ATV Skateboards Are Here!!!", (printed Jul. 11, 2003).*
Jet Propulson Laboratory: "Robotic Vehicles Group", (printed Jul. 11, 2003).*
www.segway.com, (printed Jul. 11, 2003).*
EV World, BAE Systems to Market Segway to British Military.*

*Primary Examiner*—Michael J. Carone
*Assistant Examiner*—Troy Chambers
(74) *Attorney, Agent, or Firm*—Oliff & Berridge, PLC

(57) ABSTRACT

The invention relates to the field of electrical firing mechanisms and particularly to a device for firing a primer of the type having, in particular, an electrical power supply for a circuit including a detector, a switch and an igniting device for igniting the primer, such as an electrical resistor or a striker and a device able to move the striker. The detector and switch may include a network of contacts able to open or close the circuit under the influence of a contact or a force and to close or open the circuit when the contact or the force has disappeared.

19 Claims, 4 Drawing Sheets

U.S. PATENT DOCUMENTS 4,799,381 A * 1/1989 Tromp ..... 177/211
4,839,480 A * 6/1989 Bickley ..... 200/86 A
5,014,622 A * 5/1991 Jullian ..... 102/215
5,090,321 A * 2/1992 Abouav ..... 102/200
5,115,109 A * 5/1992 Fisher ..... 200/333
5,136,949 A * 8/1992 Grosch ..... 102/215
5,450,077 A * 9/1995 Tyburski ..... 200/86 A
5,520,114 A * 5/1996 Guimard et al. ..... 102/206
5,573,107 A * 11/1996 Nakano et al. ..... 200/311
5,600,086 A * 2/1997 Lemonnier ..... 102/401
5,710,558 A * 1/1998 Gibson ..... 200/85 R
6,021,095 A * 2/2000 Tubel et al. ..... 166/166
6,173,651 B1 * 1/2001 Pathe et al. ..... 102/200
6,417,785 B1 * 7/2002 Tyburski ..... 340/933
6,422,145 B1 * 7/2002 Gavrilovic et al. ..... 102/200

* cited by examiner

DEVICE FOR FIRING A PRIMER

BACKGROUND OF THE INVENTION

1. Field of Invention

The invention relates to the field of electrical firing mechanisms for miniature bombs, mines, missiles, and projectiles, and particularly to a device for firing a primer of the type having, in particular, an electrical power supply for a circuit including in particular, a switch, an ignition device for igniting the primer, such as an electrical resistor, or a striker and an actuation device to actuate the striker.

2. Description of Related Art

A certain number of devices for firing a primer are already known. Patent Application No. FR2742859, for example, describes a time-settable priming device including a primer, an electrical power supply for a circuit, including principally a priming resistor, a switch for switching the supply circuit of the priming resistor, a timer for setting a time delay, and a control switch for controlling switching, including a microcontroller, a code wheel, and a trapping device connected to the microcontroller.

As an example, the trapping device can be of the contact-opening type and includes a closed circuit supplied by a supply device. The trapping device may have a certain number of contacts opened by remote control, inertia, or a tripwire.

These types of contacts may have drawbacks when implemented in an antitank land mine. In certain cases, it is not possible to provide remote-controlled or inertial tripping and moreover, the tripwire does not discriminate between a soldier and a vehicle when firing the primer.

To overcome this problem and to actuate firing only in the presence of a vehicle, Patent FR2653824 states that, for recognition of a vehicle, use may be made, for example, of a detector sensitive to contact by the vehicle or to pressure, a detector sensitive to the vehicle's magnetic field, or to the change in the magnetic field of the ground caused by the vehicle, or a vibration detector. The use of double detection with an influence detector and a contact or pressure detector is also described.

Detectors sensitive to contact with, or the pressure of, a vehicle include those described in patents FR2504254 and FR2507307. FR2504254 describes an antitank mine, including a detector at its upper part that includes, in particular, a pressure plate designed to actuate firing by igniting a pyrotechnic chain composed of a striker, a primer, an ignition relay, and an ignition block for firing the true pyrotechnic charge contained in the mine.

FR2507307 describes an antitank mine having a release charge and a true charge as well as double detection of the tank with a detector for firing the release charge followed by the true charge, and a contact or pressure detector causing direct firing of the true charge.

All the devices described in the aforesaid patents have drawbacks. Thus, the plate mine described in patent FR2504254 requires the vehicle to be destroyed to pass right over the mine, which considerably reduces the probability that the mine will act on the vehicle.

Patents FR2654824 and FR2507307 teach the possibility of considerably increasing the range of a mine by using influence detection in addition to contact or pressure detection.

However, this double detection requires the presence of two separate electronic assemblies, thus, increasing the number of components and hence the cost of the primer firing device, and reducing the overall reliability of the device.

Moreover, the devices described in these latter patents do not optimize the effects of the mine explosion on the tank.

SUMMARY OF THE INVENTION

The invention provides a firing device for firing a primer, requiring a minimum of electronic components and, although using only one type of detector having a greater range than that of a device as described in Patent FR2504254, for example, enabling the effects of the explosive device associated with the firing device to be optimized.

The firing device may include at least one electrical power supply, a detector, a switch, and an ignition device, such as an electrical resistor, or a striker and device able to move the striker and ignite the primer. The detector and switch may include a network of contacts able to open or close a circuit including at least the electrical power supply, under the influence of a contact or a force, to close or open the circuit when the contact or the force disappears.

According to one particular feature, the network includes of a strip of contacts. According to another feature, the contacts include membrane switches.

According to another feature, the membrane switches include a first plate having a hole, a second plate itself having a hole, and sloping edges inscribed in the hole in the first plate, a spherical membrane shaped like an upwardly directed spherical segment attached to the ends of the sloping edges, and an electrically conducting strip attached to the lower surface of the membrane.

According to one preferred feature for introducing a detection threshold, specifically a pressure threshold, the network is disposed inside a deformable sheath made of a material whose hardness is preferably greater than 40° Shore. The choice of the shape of the sheath, the material or materials of which it is made, and the composition of the membrane switches, allows introduction of a minimum pressure threshold above which the membrane switch can close and below which it cannot do so.

According to one particular feature, this sheath is made of an extruded silicone shape whose hardness can be 60° Shore. According to one preferred feature, the sheath has several segments delimited by a change in its structure in order to facilitate its bending. According to an additional feature, this change in structure of the sheath includes reducing its thickness over all or part of its circumference and can, for example, be a recess. The switches are preferably positioned outside the straight section of the change in structure of the sheath.

According to another feature that, for example, enables a primer-tripping threshold to be introduced, the membrane switches are connected to a processor for processing electrical signals coming from the detector. The processor is able, in particular, to filter the targets and control the tripping of the primer.

According to one additional feature, the processor may include a counting module. According to another particular feature, the processor may be a microcontroller. According to another feature, the processor may be connected to the electrical power supply, to the detector, and to the primer-firing resistor.

According to an additional feature, the switch controlled by the processor is disposed between the processor and the primer-firing resistor. According to an additional feature, the timer is associated with the processor and/or the switch controlled by the processor.

The invention also relates to an explosive device of the type having an explosive charge, a primer, and a firing device for firing this explosive charge. The firing device may be a firing device according to one of the aforesaid features.

BRIEF DESCRIPTION OF THE DRAWINGS

Other advantages and characteristics will emerge from the description of particular embodiments of the invention with reference to the attached figures, wherein.

DETAILED DESCRIPTION OF PREFERRED EMBODIMENTS

Figure 1:
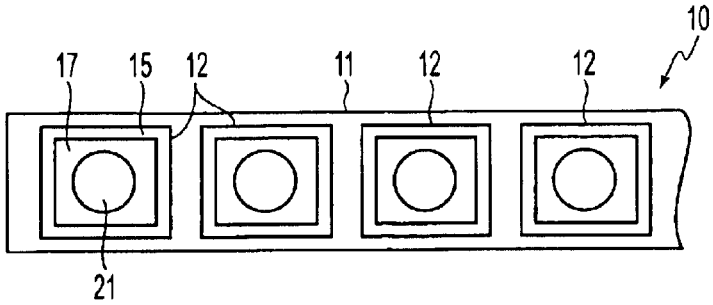
FIG. 1 shows an embodiment of the detector according to the invention.
Figure 2:
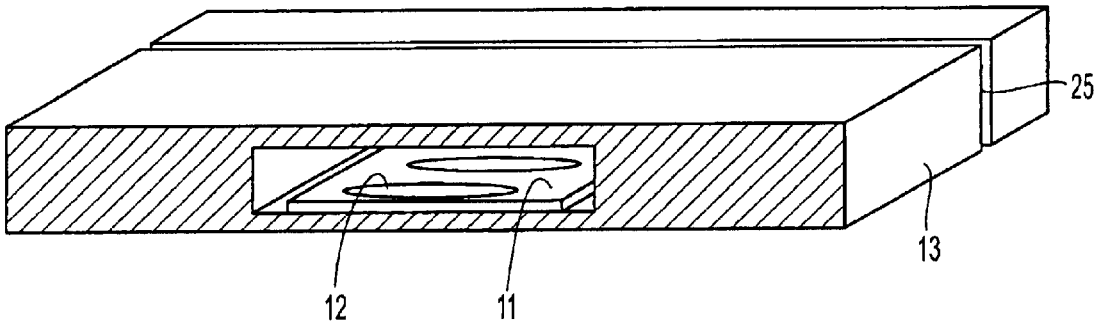
FIG. 2 is a diagram of a cross section of the detector according to this embodiment of the invention.

FIGS. 1 and 2 show a detector 10 according to the invention designed to be integrated into a firing device for firing a primer with a view to its combination with an explosive device, such as a mine.

The detector 10 includes a strip 11 of membrane switches 12 that are inserted into a sheath 13 in the shape of a tube with a rectangular cross section.

This sheath 13 is made of extruded silicone with Shore hardness 60° and obtained by extrusion. In addition, the sheath 13 has structural modifications 25 regularly distributed over its length so that it can be folded accordion-wise. These structural modifications consist in a lengthwise indentation of several millimeters in its cross section, or in other words, a recess going around the entire external periphery of sheath 13.

The outside dimensions of this sheath are, for example, width 65 mm and height 10 mm while the free internal space is 30 mm wide and 6 mm high. Its total length is 4 m and it has four structural modifications enabling it to be bent into 5 segments.

Figure 3:
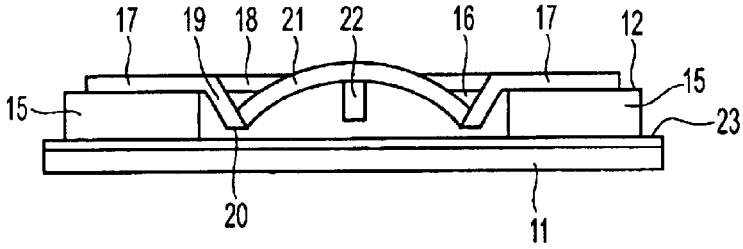
FIG. 3 illustrates a membrane switch used in the framework of this embodiment of the invention.

Strip 11 of switches 12 is, for example, 24 mm wide and is centered on the lower internal face 14 of sheath 13. Switches 12 are of the type described in Patent EP202711. As shown in FIG. 3, they have a first plate 15 having a circular hole 16, a second plate 17 having a circular hole 18 and sloping edges 19 inscribed in hole 16 in first plate 15. A spherical membrane 21 in the shape of an upwardly directed spherical segment is attached to ends 20 of sloping edges 19. An electrically conducting strip 22 is attached to the lower face of membrane 21.

Second plate 17 is glued onto first plate 15. A conducting strip 23 disposed lengthwise is centered on flexible strip 11 and each of the assemblies constituted by plates 15 and 17 of membrane 21 is attached to strip 11 and centered thereon. Thus, for each assembly, part of conducting strip 22 is vertically above part of conducting strip 23.

Figure 4:
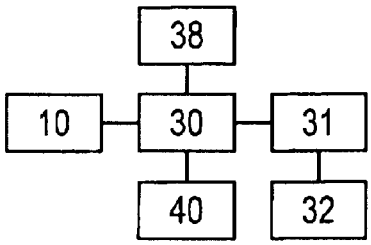
FIG. 4 is a diagram of a firing device according to a first embodiment.

As shown in FIG. 4, the detector 10 is connected to a processor 30 that processes electrical signals (0 or 5 V) generated by the detector 10. The processor 30 is additionally connected to either side of electrical power supply 40 and to a priming resistor 31 used for firing a primer 32.

Figure 5:
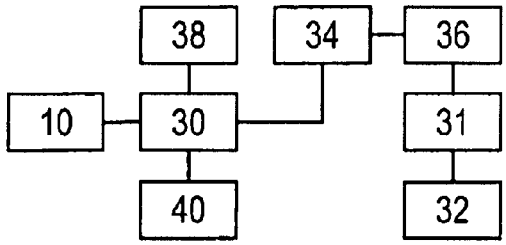
FIGS. 5 and 6 show a firing device according to a second embodiment.

As shown in FIG. 5 and in order to improve priming reliability, the processor 30 can be a microcontroller and may be connected to a timer 38 for setting a time delay, including, for example, code wheels, and a switch 34 for switching the power supply circuit of priming resistor 31 and a capacitor 36 supplying an intensity 12 when discharged. The intensity I2 is necessary because the I1 of the charging current of capacitor 36 is insufficient to cause the primer 32 to fire. Processor 30 controls the opening and/or closing of switch 34.

Figure 6:
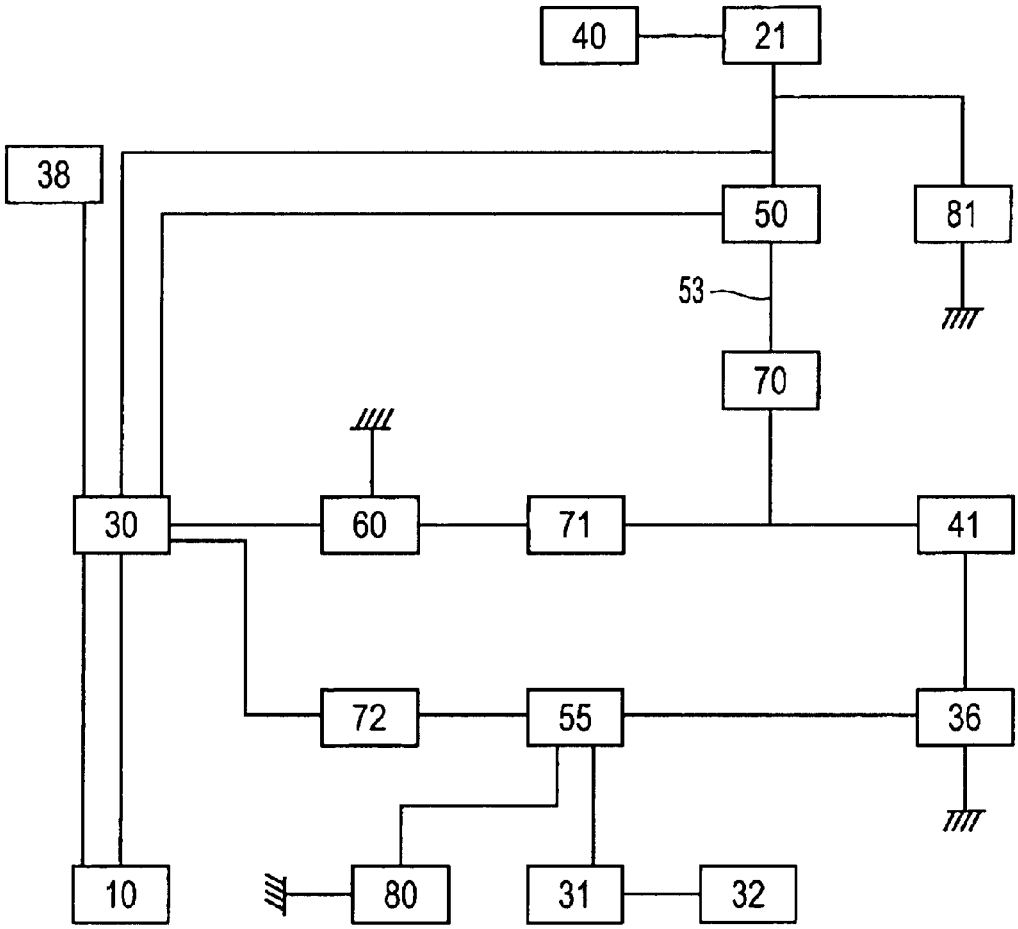

As shown schematically in FIG. 6, an electromechanical safety device 41 that includes a mechanical clock associated with a mechanical toggle switch normally in the open position that closes the circuit after this clock has run for a preset time. This switch is connected to a capacitor 36 able to supply an intensity 12 when it discharges, since the intensity I1 of the charging current supplied by the power supply 40 of this capacitor 36 is insufficient to cause the primer 32 to fire.

A transistor 50 of which the source is connected to power supply 40, the gate to processor 30, and the drain to the input of the switch of electromechanical safety device 41, and a transistor 55 of which the source is connected to priming resistor 31, the gate to processor 30 via a resistor 72, and the drain to the output of capacitor 36.

Moreover, the drain 53 of transistor 50 is connected to a short-circuit transistor 60, itself connected to the processor 30 and ground.

In addition, resistors 70, 71, 72 that limit current intensity are disposed in the circuit upstream of the electromechanical safety device and between processor 30 and transistor 55 so that, if the transistor 55 and electromechanical safety device 41 means should fail, priming resistor 31 is traversed by a current of insufficient intensity to cause the detonator to be primed.

Moreover, signaling devices 81 and 80 are disposed downstream of the electrical power supply and in parallel with priming resistor 31, respectively.

Finally, a two-position mechanical bolt 21 at the output of the power supply in a first position is able to ground all the electronic devices, while in the second position all of the electronic devices are powered but capacitor 36 is, in all cases, not connected to the power supply 40 until a safety delay generated by electromechanical safety device 41 has elapsed.

Figure 7A:
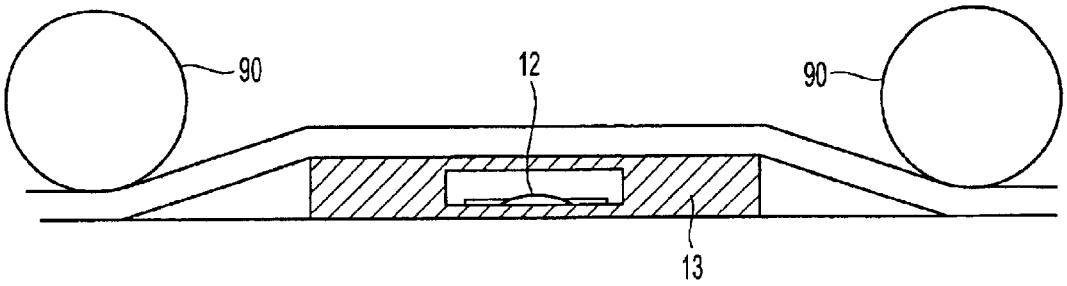
FIGS. 7*a* and 7*b* show an example of actuating a membrane switch.
Figure 7B:
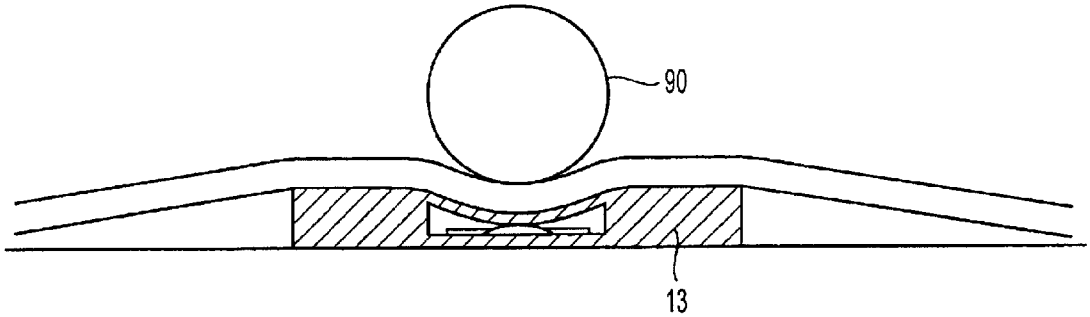
Figure 8:
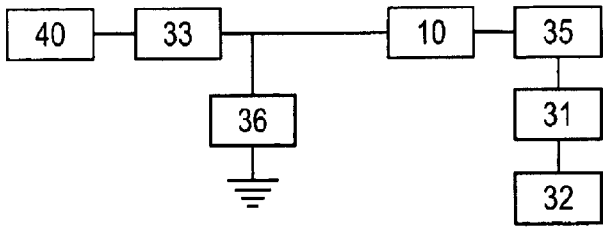
FIG. 8 shows a firing device according to a third embodiment.

The primer firing device according to the invention operates as follows. All the membrane switches in the network are initially open. As shown in FIGS. 7*a* and 7*b*, application of a tank wheel 90 to one of switches 12 brings conducting elements 22, 23 into contact then breaks this contact as soon as the wheel has passed as the switch 12 is reversed and returns to its initial position. A voltage pulse is thus generated and counted by processor 30.

The processor 30 can either immediately cause current to flow to the priming resistor 31 at an intensity sufficient to fire primer 32, or trigger this firing only once a certain number of pulses has been detected. For example, the processor 30 can be programmed to trip firing of the primer only when three pulses separated by a minimum time interval are detected, hence only after three wheels have passed, so that the explosion takes place at the most vulnerable spot in the tank, namely the ammunition magazine.

These devices can also be programmed not to fire the primer until four or five pulses separated by a minimum time interval and occurring in a limited space of time are detected in order to destroy only the track mechanism. The processor 30 can thus filter the targets.

In the example of FIGS. 5 and 6, the operation is substantially the same as described above but additional safety devices are provided to maximize safety to the individuals laying the mines. Operation is then as follows: Mechanical bolt 21 is initially in its first position and electronic devices 10, 30, 34, 36 are not energized. Using code wheels, the user sets a time delay D1 then, using a special key, turns the bolt 21 to the position in which all the electronic devices 10, 30, 34, 36 are electrically powered and the code wheels are locked. The firing device is then positioned on a mine, and this mine is buried in the ground while the detector 10 is either placed on the ground or buried.

In this position, the countdown of time delay D1, started by turning bolt 21, continues while the mechanical clock for timing the electromechanical safety device 41 is triggered. At the end of a preset clock operation time Tp1, the clock throws mechanical switch and hence closes the part of the circuit located between transistor 50 and capacitor 36.

Thus, in all cases where the time delay D1 set by the user is less than preset Tp1 or if processor 30 or transistors 50, 55, 60 should fail, firing can in all cases occur only after this time Tp1 has elapsed.

After the countdown of value D1, processor 30 deactivates short-circuit transistor 60 and activates transistor 50 which then becomes conducting. Capacitor 36 is then charged and, after a preset time Tp2, activation of transistor 55 by processor 30 causes capacitor 36 to discharge through this transistor 55 and priming resistor 31, as the intensity I2 in the latter is then sufficient to trigger the detonator and explode the mine.

Activation of transistor 55 is operated as described above, namely as soon as a voltage pulse is detected by detector 10 or after a certain number of pulses have been detected, three for example, to reach a sensitive part of the tank or four or even five to destroy only the track mechanism. This pulse number is preferably combined with the time between, and including, these pulses.

It should also be noted that, for safety reasons, it is preferable for the capacitor charging time Tp2 to be long relative to its discharging time. Hence, dysfunctions resulting in simultaneous operation of all the transducers (in the case of EMP and nuclear effects) would have no consequences.

According to one embodiment of the invention, the delay device can be simplified as shown in FIG. 6. The priming device then has detector 10, an electrical power supply 40, in this case batteries, a time-delay opening relay 33, a time-delay closing relay 35, a capacitor 36, and a priming resistor 31 of primer 32.

As soon as the batteries are installed, the two relays are energized. Since relay 33 is closes first, capacitor 36 is charged. This relay 33 opens after a time Tp4 then relay 35 closes and, as soon as one of the membrane switches 12 of the detector 10 closes the circuit, capacitor 36 discharges through resistor 31, causing primer 32 to fire.

In the case of priming by displacement of a mechanical part, discharging the capacitor 36 energizes a solenoid, activation of which unlocks the electromechanical device 41 which primes the detonator.

Due to the reversibility of the detector 10 according to the invention, it is possible to adapt the firing modalities according to the nature of the target. Thus, if the target is a tank column as shown in FIG. 9, it is possible to program processor 30 so that the primer 32 is not fired until a certain number of tanks has passed.

Figure 9:
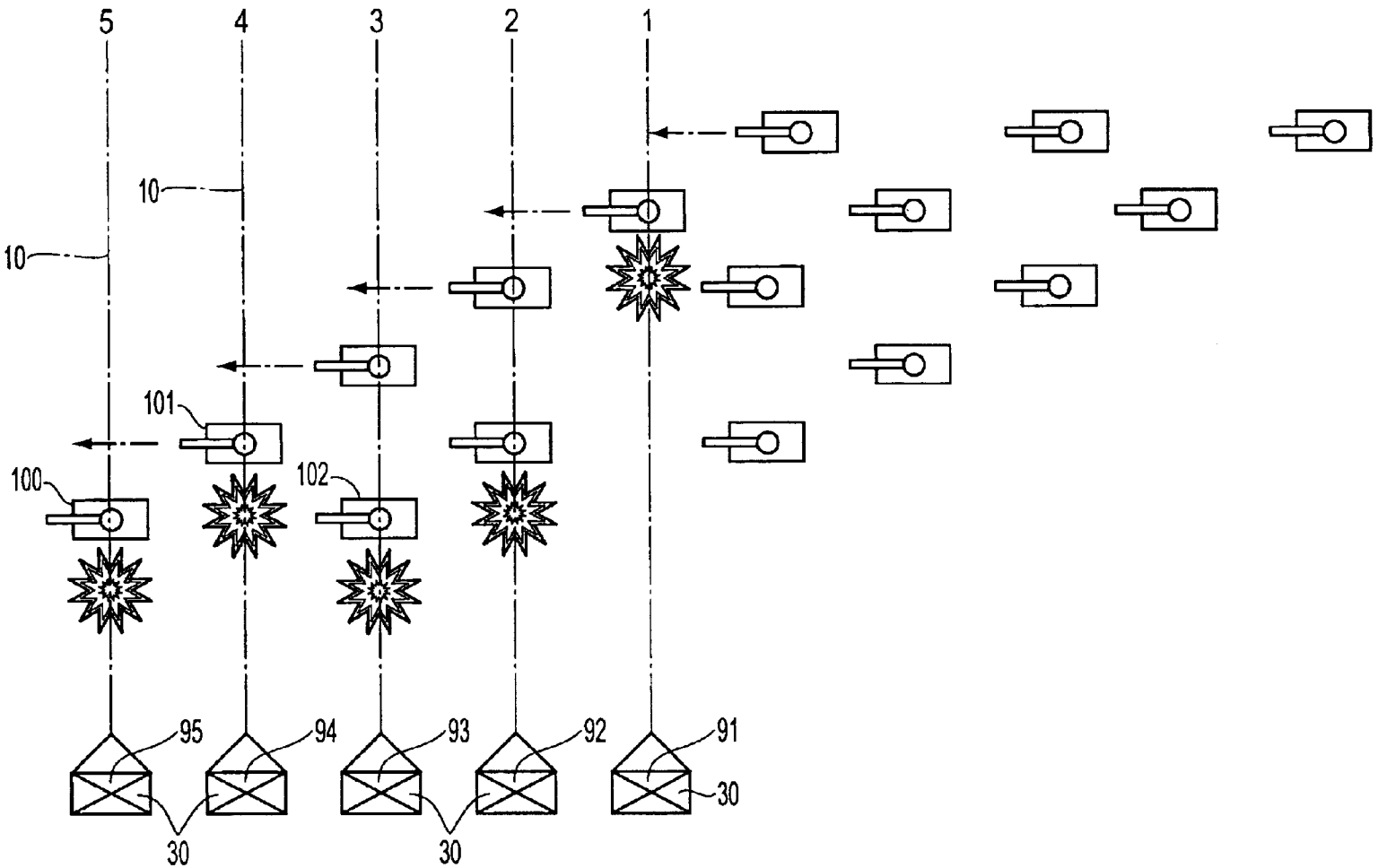
FIG. 9 shows a particular arrangement of explosive devices using a firing device according to the invention.

The explosive devices 91–95 shown in FIG. 9 are disposed every 30 meters over a distance of 150 meters. According to a possible embodiment of the invention, each of these five explosive devices 91–95 has its own detector 10 connected to for processor 30.

However, the firing device of explosive devices 91, 92, 94, and 95 may be deactivated while the firing explosive device 93 is activated. This deactivation consists of preventing the primer 32 from firing even if a tank is detected. Thus, tanks can drive over the detector 10 and be detected without the primer 32 being fired. Firing can be accomplished, for example, by software in the microcontroller of processor 30 or by hardware with a switch, etc.

Also, the processor 30 associated with explosive devices 91, 92, 94 and 95 may be programmed to trigger firing, after activation, when a tank is first detected by the associated detector 10.

Processor 30 associated with explosive device 93 may be programmed to trigger firing of explosive device 93 when passage of a third tank is detected, for example, and to activate the processor 30 of the other explosive devices after this third passage has been detected. This activation can be effected by wire or by radio with a transceiver assembly.

Thus, detection of the passage of tanks 100 and 101 over the detector 10 associated with explosive device 93 (i.e., the only explosive device whose firing device is activated) has no effect. On the other hand, passage of a third tank, in this case tank 102, causes explosive device 93 to explode and activates the firing device associated with explosive devices 91, 92, 94, and 95. Thus, detection of a tank by one of the detectors 10 associated with these explosive devices causes the primer 32 to fire and hence the corresponding explosive device to explode.

Such operation of the firing device has a trapping effect. The tanks located between the detector 10 of explosive device 91 and those of explosive device 95 are destroyed in their turn when explosive device 93 explodes, as soon as they are detected by the detector 10 of an explosive device that has not yet exploded, continuing until all the explosive devices 91–95 have exploded. Thus, in the example of the tank column in FIG. 9, at least five tanks are destroyed thanks to the utilization of the firing device according to the invention.

Numerous modifications may be made to the embodiment described without thereby departing from the framework of the invention. Thus, the network can have a star shape or a square shape, etc., and in the case of a strip 11 of contacts, the network can be approximately one meter or one decameter long, and be connected to several explosive devices.

Moreover, by adding a receiver associated with the firing device, it is possible, using a transmitter, to cause, for example, a switch in the firing circuit of the primer 32 to close, in which case firing can occur at the proper time after detection of a tank by the detector 10. Thus, it is possible to select the target.

What is claimed is:

1. A firing device for firing a primer, comprising:

a longitudinal pressure resistant sheath having a longitudinal opening therein, the pressure resistant sheath selectively configurable to provide a minimum pressure threshold;

a detector mounted within the longitudinal opening, the detector comprising a network of contacts able to open or close under an influence of a force and close or open when the force is removed;

at least one electrical power supply electrically connected to the detector; and an ignition device electrically connected to the detector; and a primer connected to the ignition device.

2. The firing device according to claim 1, wherein the ignition device includes an electrical resistor.

3. The firing device according to claim 1, wherein the ignition device includes a striker and device able to move the striker.

4. The firing device according to claim 1, wherein the network is composed of a strip of contacts.

5. The firing device according to claim 4, wherein the contacts include membrane switches.

6. The firing device according to claim 1, wherein the contacts include membrane switches.

7. The firing device according to claim 6, wherein the membrane switches include a first plate having a hole, a second plate having a hole, and sloping edges embedded in the hole of the first plate, a membrane shaped like an upwardly directed spherical segment attached to the ends of the sloping edges, and an electrically conducting strip attached to the lower surface of the membrane.

8. The firing device according to claim 4, wherein the network is disposed inside a sheath, which includes the recess and the pressure resistant cover, made of deformable material.

9. The firing device according to claim 1, wherein the sheath has an extruded shape and is made of a silicone material.

10. The firing device according to claim 9, wherein the sheath is formed in several segments to facilitate bending.

11. The firing device according to claim 10, wherein the detector and a switch are connected to a processor, the processor processing electrical signals coming from detector to trigger priming.

12. A The firing device according to claim 1, wherein the detector and a switch are connected to a processor, the processor processing electrical signals coming from detector to trigger priming.

13. The firing device according to claim 12, wherein the processor includes a counting module.

14. The firing device according to claim 12, wherein the processor includes a microcontroller.

15. The firing device according to claim 12, wherein the processor is connected to at least one of the at least one electrical power supply, to the detector, and to the ignition device.

16. The firing device according to claim 15, wherein a control switch controlled by the processor is disposed between the processor and the ignition device.

17. The firing device according to claim 12, wherein a control switch controlled by the processor is disposed between the processor and the ignition device.

18. The firing device according claim 17, wherein the processor controls a timer used to delay the firing of the primer.

19. The firing device according claim 12, wherein the processor controls a timer used to delay the firing of the primer.

* * * * *

UNITED STATES PATENT AND TRADEMARK OFFICE

CERTIFICATE OF CORRECTION

PATENT NO. : 6,748,869 B1
DATED : June 15, 2004
INVENTOR(S) : Boyer et al.

It is certified that error appears in the above-identified patent and that said Letters Patent is hereby corrected as shown below:

Title page,
Item [75], Inventors, should read -- Jean-Louis Boyer, Collobrieres (FR); André Gilson, Brussels (BE) --
Item [56], References Cited, U.S. PATENT DOCUMENTS, insert:

| | | | |
|---|---|---|---|
| 3,398,397 * | 8/1968 | O'Connell | 200/86 R |
| 3,703,866 * | 11/1972 | Semenza | 102/238 |
| 3,717,094 * | 2/1973 | Morrow | 102/427 |
| 3,747,526 * | 7/1973 | Jany | 102/274 |
| 3,754,508 * | 8/1973 | Dalton | 102/215 |
| 3,830,991 * | 8/1974 | Durocher | 200/86 R |
| 3,884,151 * | 4/1975 | Madlener et al. | |
| 3,898,421 * | 8/1975 | Suzumura | |
| 3,968,749 * | 7/1976 | Malm | 102/429 |
| 4,066,851 * | 1/1978 | White et al. | |
| 4,127,752 * | 11/1978 | Lowthrop | |
| 4,127,758 * | 11/1978 | Lowthrop | |
| 4,143,598 * | 3/1979 | Marer | 102/429 |
| 4,463,681 * | 8/1984 | Tranin et al. | 102/424 |
| 4,476,784 * | 10/1984 | Reynes | 102/424 |
| 4,524,249 * | 6/1985 | Farrel | |
| 4,632,031 * | 12/1986 | Jarrott et al. | 102/200 |
| 4,674,047 * | 6/1987 | Tyler et al. | 102/200 |
| 4,695,681 * | 9/1987 | Velleman | 200/5 A |
| 4,712,423 * | 12/1987 | Siffert et al. | 177/132 |
| 4,742,196 * | 5/1988 | Kelly | 200/85 R |
| 4,762,970 * | 8/1988 | Brinsley | 200/85 R |
| 4,766,271 * | 8/1988 | Mitsuhashi et al. | 200/5 A |
| 4,799,381 * | 1/1989 | Tromp | 177/211 |
| 4,818,829 * | 4/1989 | Nopper et al. | |
| 4,839,480 * | 6/1989 | Bickley | 200/86 A |
| 5,014,622 * | 5/1991 | Jullian | 102/215 |
| 5,090,321 * | 2/1992 | Abouav | 102/200 |
| 5,115,109 * | 5/1992 | Fisher | 200/333 |
| 5,136,949 * | 8/1992 | Grosch | 102/215 |
| 5,450,077 * | 09/1995 | Tyburski | 200/86 A |
| 5,485,788 * | 1/1996 | Corney | |
| 5,520,114 * | 5/1996 | Guimard et al. | 102/206 |
| 5,573,107 * | 11/1996 | Nakano et al. | 200/311 |
| 5,600,086 * | 2/1997 | Lemonnier | 102/401 |
| 5,710,558 * | 1/1998 | Gibson | 200/85 R |
| 5,828,016 * | 10/1998 | Grannan et al. | |
| 6,021,095 * | 2/2000 | Tubel et al. | 166/166 |
| 6,082,265 * | 7/2000 | Sakamoto et al. | |
| 6,173,651 * | 1/2001 | Pathe et al. | 102/200 |
| 6,417,785 * | 7/2002 | Tyburski | 340/933 |
| 6,422,145 * | 7/2002 | Gavrilovic et al. | 102/200 |
| RE 33651 * | 7/1991 | Blonder et al. | |

UNITED STATES PATENT AND TRADEMARK OFFICE

CERTIFICATE OF CORRECTION

PATENT NO. : 6,748,869 B1
DATED : June 15, 2004
INVENTOR(S) : Boyer et al.

It is certified that error appears in the above-identified patent and that said Letters Patent is hereby corrected as shown below:

Title page (cont'd),
FOREIGN PATENT DOCUMENTS, insert

--

| | | |
|---|---|---|
| DE | 32 06 285 A1 | 9/1983 |
| DE | 35 45 289 A1 | 6/1987 |
| DE | 37 06 562 C1 | 7/1996 |
| EP | 0093804 B1 | * 11/1986 |
| EP | 0093804A1 | * 11/1983 |
| EP | 0693762 A1 | * 1/1996 |
| EP | 0880669 B1 | * 11/1999 |
| WO | 97/23761 | * 7/1997 |

--

OTHER PUBLICATIONS, insert

--

UK Patent Application GB 2299850, Oct. 1996, Andrea.*
Trend Times, "Gas Powered ATV Skateboards Are Here!!!", (printed Jul. 11, 2003).*
Jet Propulsion Laboratory: "Robotic Vehicles Group", (printed Jul. 11, 2003).*
www.segway.com, (printed Jul. 11, 2003).*
EV World, BAE Systems to Market Segway to British Military.

* cited by examiner

Signed and Sealed this

Fifth Day of October, 2004

JON W. DUDAS
*Director of the United States Patent and Trademark Office*